US006463936B1

(12) United States Patent
Hicks

(10) Patent No.: US 6,463,936 B1
(45) Date of Patent: Oct. 15, 2002

(54) CIGARETTE HANDLING SYSTEM

(76) Inventor: Douglas A. Hicks, 357 14th Ave. SW., Largo, FL (US) 33770

( * ) Notice: Subject to any disclaimer, the term of this patent is extended or adjusted under 35 U.S.C. 154(b) by 33 days.

(21) Appl. No.: 09/706,415

(22) Filed: Nov. 3, 2000

(51) Int. Cl.[7] ..... A24F 13/18; B65D 85/10

(52) U.S. Cl. ..... 131/256; 131/240.1; 131/241; 131/242; 131/187; 131/194; 206/242; 206/265

(58) Field of Search ..... 131/240.1, 241, 131/242, 250, 256, 257, 175, 194, 187, 180, 196, 235.1, 237; 206/242, 251, 265, 268; D27/183, 186, 189

(56) References Cited

U.S. PATENT DOCUMENTS

| | | | | | |
|---|---|---|---|---|---|
| 439,309 | A | * | 10/1890 | Smith et al. | 131/251 |
| 1,519,137 | A | * | 12/1924 | Hothersall | |
| 1,994,933 | A | * | 3/1935 | Visser | 131/235.1 |
| 2,093,309 | A | * | 9/1937 | Cook | 131/233 |
| 2,286,389 | A | * | 6/1942 | Sowin | 206/259 |
| 2,335,674 | A | * | 11/1943 | Horlick | |
| 2,359,529 | A | * | 10/1944 | Robb | 131/250 |
| 2,440,882 | A | * | 5/1948 | Walton | 131/175 |
| 2,715,961 | A | * | 8/1955 | Field | 131/235.1 |
| 3,756,252 | A | * | 9/1973 | Vigorito | 131/256 |
| 3,994,308 | A | * | 11/1976 | Pancer | |
| 4,660,575 | A | * | 4/1987 | Andreason et al. | 131/175 |
| 4,819,666 | A | * | 4/1989 | Turver | 131/175 |
| 4,886,076 | A | * | 12/1989 | Gilbert et al. | 131/235.1 |
| 5,345,953 | A | * | 9/1994 | Taylor | 131/256 |
| 5,385,157 | A | * | 1/1995 | Smith et al. | 131/235.1 |
| 5,499,634 | A | * | 3/1996 | Herrmann | 131/256 |
| 5,529,079 | A | * | 6/1996 | Tu | 131/175 |
| 6,089,236 | A | * | 7/2000 | Alexsen | 131/256 |
| 6,102,047 | A | * | 8/2000 | Manderick | 131/239 |
| 6,109,271 | A | * | 8/2000 | Webber et al. | 131/240.1 |
| 6,273,094 | B1 | * | 8/2001 | Potter | 131/175 |

FOREIGN PATENT DOCUMENTS

| | | | | |
|---|---|---|---|---|
| DE | 881511 | * | 4/1943 | |
| DE | 2243738 | * | 3/1974 | |
| DE | 3414677 | * | 10/1985 | |
| FR | 2594302 | * | 8/1987 | |
| GB | 1278 | * | 3/1882 | 131/256 |
| GB | 262480 | * | 6/1927 | |
| GB | 2178642 | * | 2/1987 | |
| JP | 10033156 | * | 2/1998 | |
| JP | 10234348 | * | 9/1998 | |
| JP | 2000023653 | * | 1/2000 | |

* cited by examiner

*Primary Examiner*—Steven P. Griffin
*Assistant Examiner*—Carlos Lopez

(57) ABSTRACT

A cigarette handling system comprises a housing in a generally tubular configuration. The housing is formed with a sidewall and an integrally formed circular bottom wall and an open upper end. The housing is fabricated of a rigid moldable plastic material selected from the class of rigid moldable plastics. The housing has an exterior surface with a reduced diameter at the bottom wall and enlarged adjacent to the top. The housing has an interior surface, the interior surface being hollow for forming a chamber adapted to receive a lit cigarette and with the sidewall tapering radially outwardly from adjacent to the bottom toward the upper end with the upper end being end being flared slightly. This is to facilitate the guidance and entry of the lit end of a cigarette into the chamber. A supplemental layer of heat resistant material on the interior surface of the housing.

4 Claims, 4 Drawing Sheets

FIG 3A
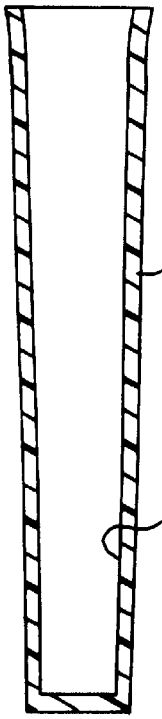
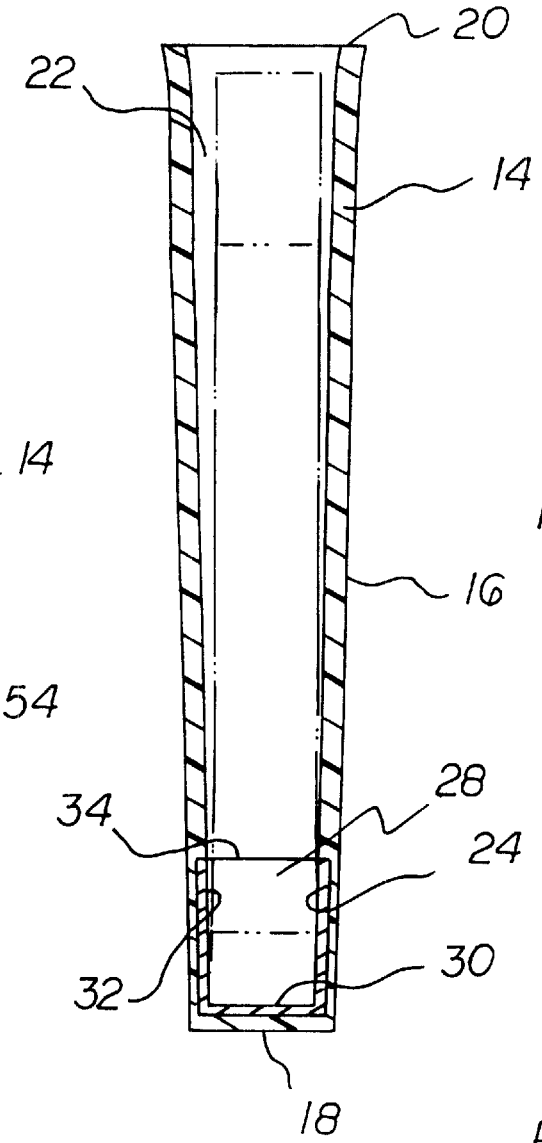
FIG 3
FIG 4
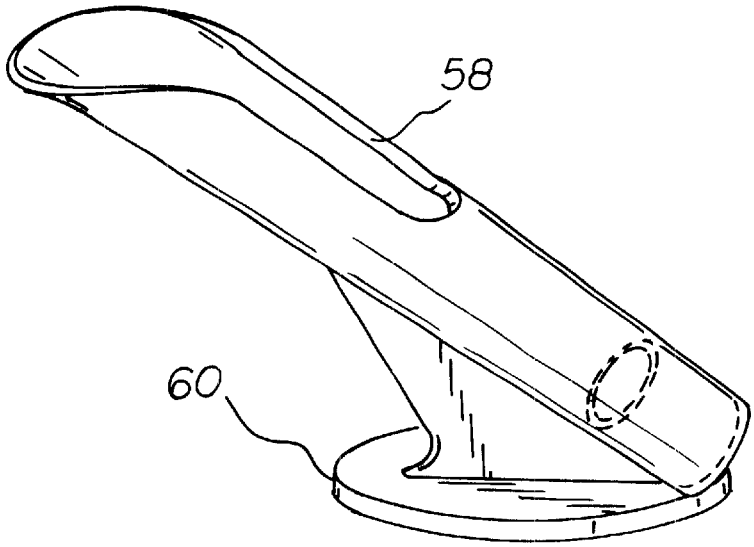

CIGARETTE HANDLING SYSTEM

BACKGROUND OF THE INVENTION

1. Field of the Invention

The present invention relates to a cigarette handling system and more particularly pertains to extinguishing a lit cigarette and retaining the unlit cigarette for relighting in a safe, convenient and taste-retaining manner.

2. Description of the Prior Art

The use of cigarette handling devices of known designs and configurations is known in the prior art. More specifically, cigarette handling devices of known designs and configurations previously devised and utilized for the purpose of extinguishing cigarettes through known methods and apparatuses are known to consist basically of familiar, expected, and obvious structural configurations, notwithstanding the myriad of designs encompassed by the crowded prior art which has been developed for the fulfillment of countless objectives and requirements.

U.S. Pat. No. 4,660,575 issued Apr. 28, 1987, to Andreason, et al, discloses a cigarette extinguisher. U.S. Pat. No. 4,886,076 issued Dec. 12, 1989, to Gilbert et al discloses a cigarette snuffer. U.S. Design Pat. No. 344,612 issued Feb. 22, 1994, to Robert F. Dean discloses a combined cigarette snuffer and holder. U.S. Pat. No. 5,345,953 issued Sep. 13, 1994, to Taylor discloses a cigarette snuffer. Finally, U.S. Pat. No. 5,499,634 issued Mar. 19, 1996, to Herrmann discloses a cigarette snuffer.

While these devices fulfill their respective, particular objectives and requirements, the aforementioned patents do not describe a cigarette handling system that allows extinguishing a lit cigarette and retaining the unlit cigarette for relighting in a safe, convenient and taste-retaining manner.

In this respect, the cigarette handling system according to the present invention substantially departs from the conventional concepts and designs of the prior art, and in doing so provides an apparatus primarily developed for the purpose of extinguishing a lit cigarette and retaining the unlit cigarette for relighting in a safe, convenient and taste-retaining manner.

Therefore, it can be appreciated that there exists a continuing need for a new and improved cigarette handling system which can be used for extinguishing a lit cigarette and retaining the unlit cigarette for relighting in a safe, convenient and taste-retaining manner. In this regard, the present invention substantially fulfills this need.

SUMMARY OF THE INVENTION

In view of the foregoing disadvantages inherent in the known types of cigarette handling devices of known designs and configurations now present in the prior art, the present invention provides an improved cigarette handling system. As such, the general purpose of the present invention, which will be described subsequently in greater detail, is to provide a new and improved cigarette handling system and method which has all the advantages of the prior art and none of the disadvantages.

To attain this, the present invention essentially comprises a housing in a generally tubular configuration. The housing is formed with a sidewall, an integrally formed circular bottom wall, and an open upper end. The housing is fabricated of a rigid moldable plastic material selected from the class of rigid moldable plastics including polypropylene, polyethylene and nylon, preferably polypropylene. The housing has an exterior surface with a diameter of about 0.470 inches adjacent to the bottom wall and about 0.570 inches adjacent to the upper end. The housing also has an interior surface with a diameter of about 0.350 inches adjacent to the bottom. The interior surface of the housing is hollow for forming a chamber adapted to receive a lit cigarette. The sidewall tapers radially outwardly from adjacent to the bottom toward the upper end with a taper of about 1 degree with respect to its axis over the majority of its extent. The sidewall has an upper end being flared slightly to facilitate the guidance and entry of the lit end of a cigarette into the chamber. The lower end of the chamber has an undercut recess extending from the bottom wall to about 1.667 inches toward the upper end. A cylindrical cup is next provided. The cup is fabricated of a hard metal selected from the class of rigid metals including aluminum, brass and steel, preferably aluminum. The cup is positioned at the lower extent of the chamber. The cup has a lower circular plate positioned on the bottom wall of the housing. The cup also has a cylindrical sidewall located within the recess. The cup also has an open upper end adapted to receive the lit end of a cigarette. The cup has an interior surface in essential alignment with the interior surface of the housing adjacent to the lower end. Next provided is a cylindrical stopper. The stopper has a diameter to fit over the upper end of the housing. The stopper has a cylindrical stopper of a reduced diameter extending inwardly into the housing to seal off and terminate the flow of oxygen into the housing. A hinge is next provided. The hinge is integrally formed with the interior surface of the housing adjacent to the upper end and to the stopper. Next provided is a lock. The lock is formed of a projection extending radially from the upper edge of the housing diametrically opposed from the hinge and a C-shaped clamp extending outwardly from the stopper adapted to removably couple with respect to the projection.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved cigarette handling system which has all of the advantages of the prior art cigarette handling devices of known designs and configurations and none of the disadvantages.

It is another object of the present invention to provide a new and improved cigarette handling system which may be easily and efficiently manufactured and marketed.

It is further object of the present invention to provide a new and improved cigarette handling system which is of durable and reliable constructions.

An even further object of the present invention is to provide a new and improved cigarette handling system which is susceptible of a low cost of manufacture with regard to both materials and labor, and which accordingly is then susceptible of low prices of sale to the consuming public, thereby making such cigarette handling system economically available to the buying public.

Even still another object of the present invention is to provide a cigarette handling system for extinguishing a lit cigarette and retaining the unlit cigarette for relighting in a safe, convenient and taste-retaining manner.

Lastly, it is an object of the present invention to provide a new and improved cigarette handling system comprising a housing in a generally tubular configuration. The housing is formed with a sidewall and an integrally formed circular bottom wall and an open upper end. The housing is fabricated of a rigid moldable plastic material. The housing has an exterior surface with a reduced diameter of about 0.470 inches at the bottom wall and enlarged to about 0.570 inches adjacent to the top. The housing has an interior surface with a lesser diameter of about 0.350 inches at the bottom wall. The interior surface is hollow for forming a chamber adapted to receive a lit cigarette and the sidewall tapers radially outwardly from adjacent to the bottom toward the upper end. The upper end is flared slightly to facilitate the guidance and entry of the lit end of a cigarette into the chamber. A supplemental layer of heat resistant material is provided on the interior surface of the housing.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 3 is a cross-sectional view taken along line 3—3 of FIG. 1.

FIG. 3A is a cross-sectional view taken along line 3—3 of FIG. 1 but illustrating an alternate embodiment of the invention.

FIG. 4 is a perspective view of another alternate embodiment of the invention.

The same reference numerals refer to the same parts throughout the various Figures.

DESCRIPTION OF THE PREFERRED EMBODIMENT

Figure 1:
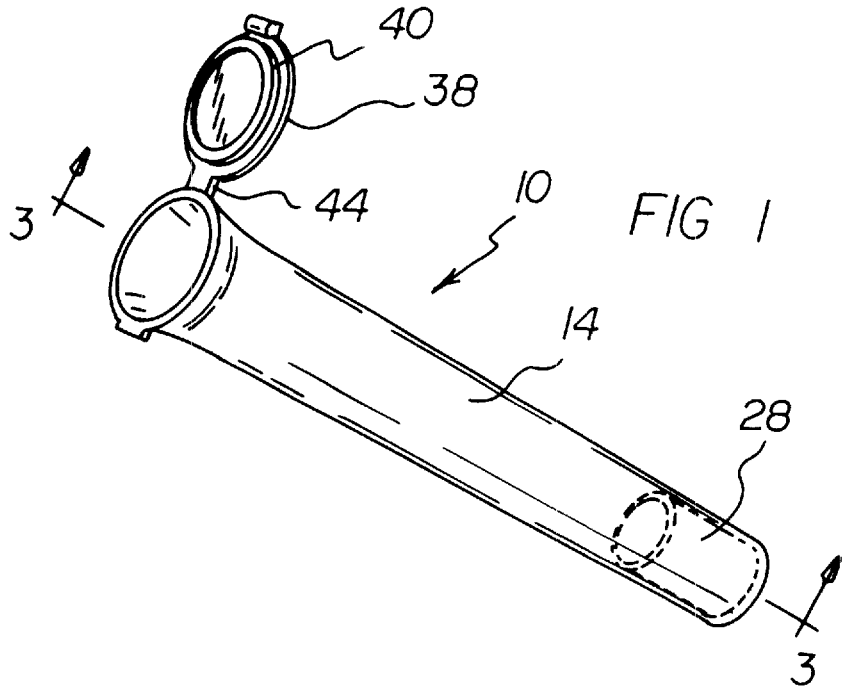
FIG. 1 is a perspective view of the cigarette handling system constructed in accordance with the principles of the present invention.
Figure 2:
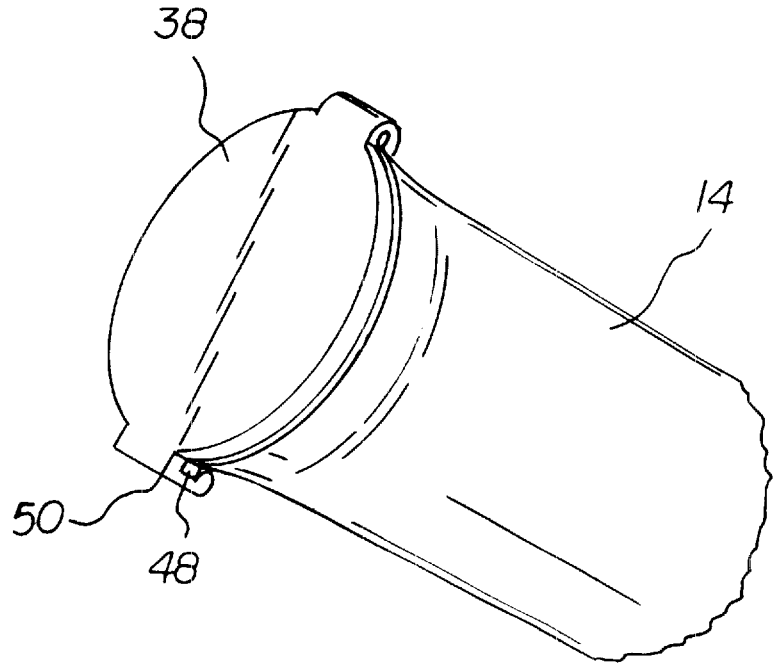
FIG. 2 is an enlarged perspective view of the upper extent of the housing shown in FIG. 1 but with the stopper in the closed position.

With reference now to the drawings, and in particular to FIG. 1 thereof, the preferred embodiment of the new and improved cigarette handling system embodying the principles and concepts of the present invention and generally designated by the reference numeral 10 will be described.

The present invention, the cigarette handling system 10 is comprised of a plurality of components. Such components in their broadest context include a housing and a supplemental layer of heat resistant material. Such components are individually configured and correlated with respect to each other so as to attain the desired objective.

First provided is a housing 14 in a generally tubular configuration. The housing is formed with a sidewall 16, an integrally formed circular bottom wall 18, and an open upper end 20. The housing is fabricated of a rigid moldable plastic material selected from the class of rigid moldable plastics including polypropylene, polyethylene and nylon, preferably polypropylene. The housing has an exterior surface with a diameter of about 0.470 inches adjacent to the bottom wall and about 0.570 inches adjacent to the upper end. The housing also has an interior surface with a diameter of about 0.350 inches adjacent to the bottom wall. The interior surface of the housing is hollow for forming a chamber 22 adapted to receive a lit cigarette. The sidewall tapers radially outwardly from adjacent to the bottom toward the upper end with a taper of about 1 degree with respect to its axis over the majority of its extent. The sidewall has an upper end being flared slightly to facilitate the guidance and entry of the lit end of a cigarette into the chamber. The lower end of the chamber has an undercut recess 24 extending from the bottom wall to about 1.667 inches toward the upper end.

A cylindrical cup 28 is next provided. The cup is fabricated of a hard metal selected from the class of rigid metals including aluminum, brass and steel, preferably aluminum. The cup may also be fabricated of a rigid, moldable, heat resistant plastic selected from the class of rigid, moldable, heat resisitant plastics including CPVC, teflon and PEEK, preferably CPVC. The cup is positioned at the lower extent of the chamber. The cup has a lower circular plate 30 positioned on the bottom wall of the housing. The cup also has a cylindrical sidewall 32 located within the recess. The cup also has an open upper end 34 adapted to receive the lit end of a cigarette. The cup has an interior surface in essential alignment with the interior surface of the housing adjacent to the lower end.

Next provided is a cylindrical stopper 38. The stopper has a diameter to fit over the upper end of the housing. The stopper has a cylindrical stopper 40 of a reduced diameter extending inwardly into the housing to seal off and terminate the flow of oxygen into the housing.

A hinge 44 is next provided. The hinge is integrally formed with the interior surface of the housing adjacent to the upper end and to the stopper.

Next provided is a lock. The lock is formed of a projection 48 extending radially from the upper edge of the housing diametrically opposed from the hinge and a C-shaped clamp 50 extending outwardly from the stopper adapted to removably couple with respect to the projection.

Shown in FIG. 3A is an alternate embodiment of the invention. In this embodiment the supplemental layer 54 is a coating of a high heat resistant plastic, preferably polyamide. The lower extent of the chamber must be of a material which will not give off carcinogenic fumes when contacted by the heat of a cigarette.

An additional alternate embodiment of the invention is shown in FIG. 4. This embodiment includes a slot 58 formed in the side wall from the upper end to a location adjacent to the longitudinal midpoint of the sidewall. Also included in this embodiment is a base 60 to support the sidewall at an angle of about 45 degrees from the vertical.

Figure 5:
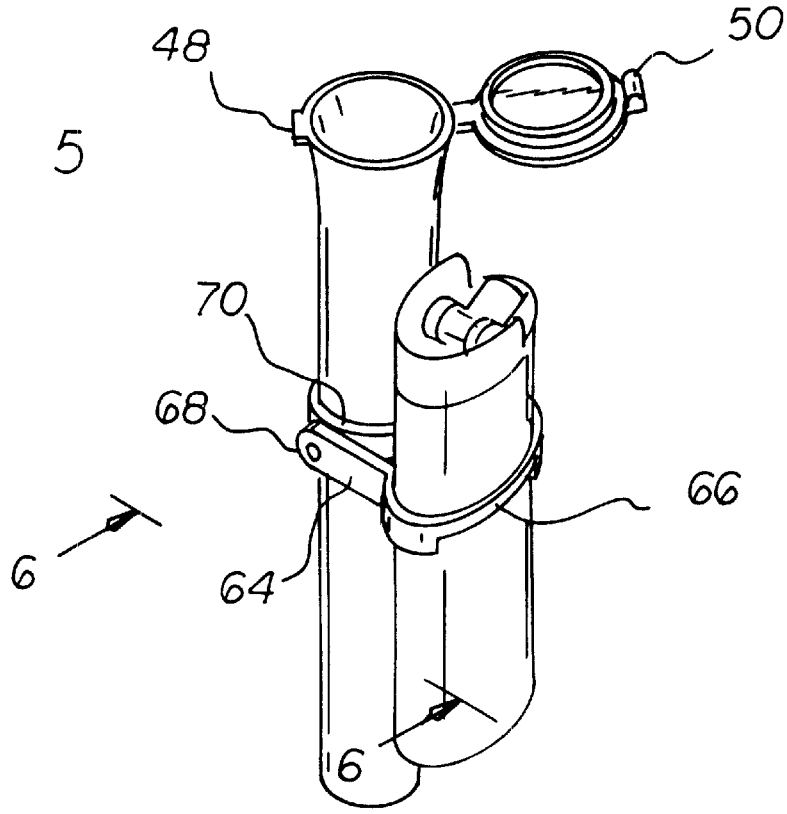
FIG. 5 is a perspective illustration of yet another alternate embodiment of the invention.
Figure 6:
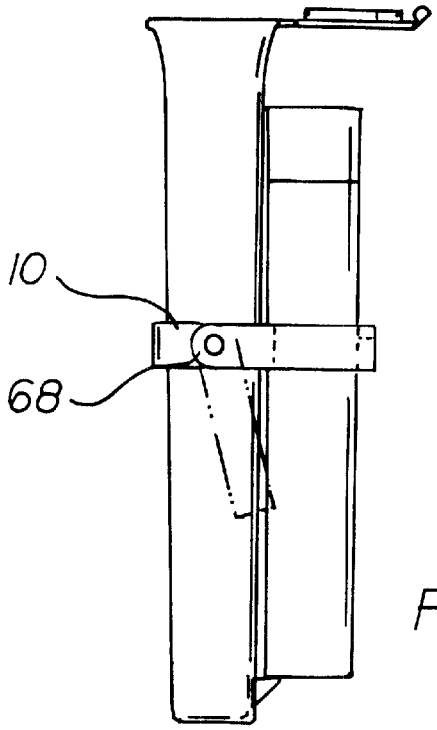
FIG. 6 is a cross-sectional view taken along line 6—6 of FIG. 5.

Another alternate embodiment of the invention is shown in FIG. 5. This embodiment further includes a generally U-shaped resilient component 64. The wire has a central extent 66 in a generally oval shape pivotally secured to a central extent of the sidewall. The component also has spaced free ends 68 adapted to pivotally couple to an oval collar 70 secured to a central extent of the housing for optionally holding a lighter.

Figure 7:
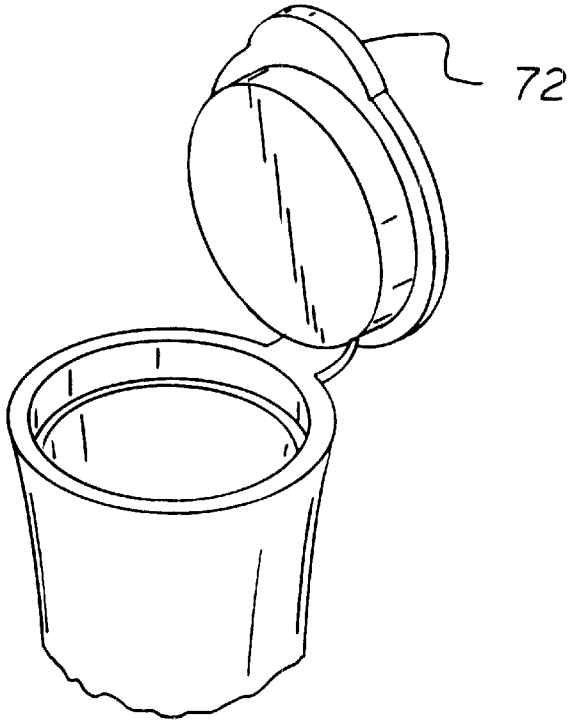
FIG. 7 is a perspective illustration of a variation capable of use in association with the FIG. 1 embodiment.

FIG. 7 is a perspective illustration of a variation capable of use in association with the FIG. 1 embodiment or any other embodiment employing a stopper. Such system further includes a tab 72 extending radially outwardly from the edge of the stopper remote from the hinge. This allows for contact by the finger of a user to facilitate the opening of the stopper in a one handed operation.

Figure 8:
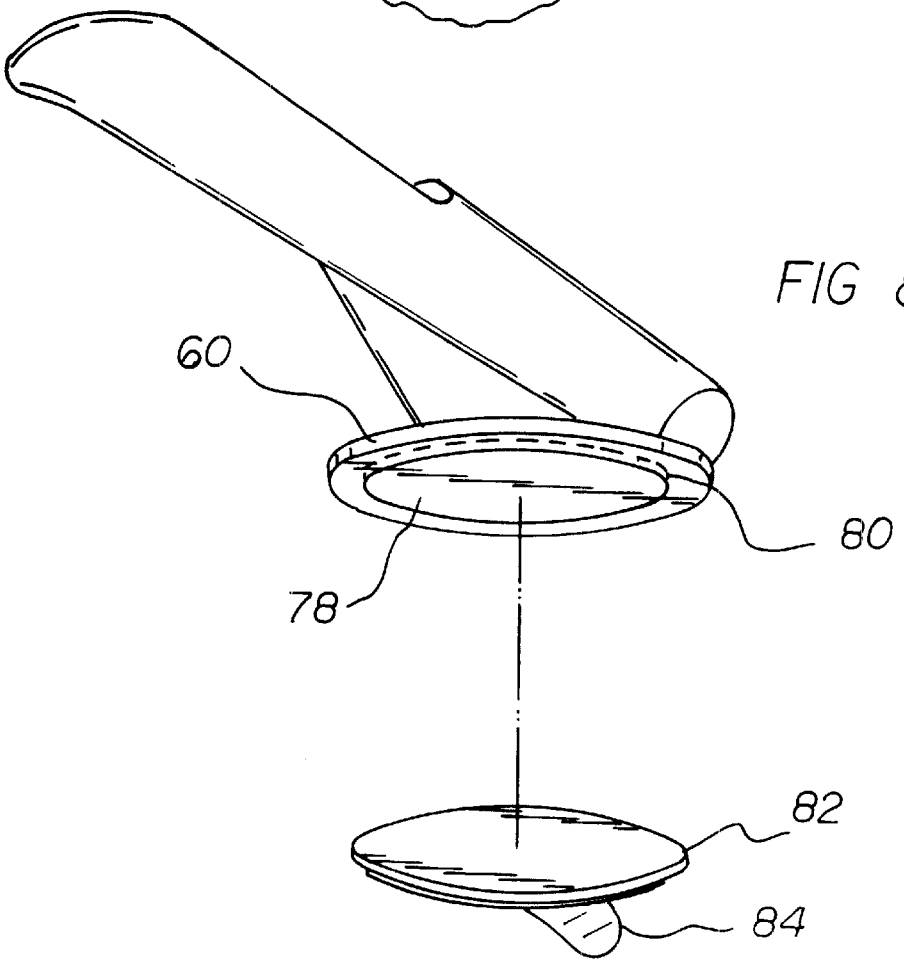
FIG. 8 is a perspective illustration of a variation capable of use in association with the FIG. 4 embodiment.

FIG. 8 is a perspective illustration of a variation capable of use in association with the FIG. 4 embodiment or any other embodiment employing a base. Such embodiment further includes a base 60 having a planar lower surface with securement means to hold the base on to a recipient surface. The securement means in one variation is a circular magnet 78 coupled as by glue 80 to the planar surface or coupled by a cover layer holding the magnet to the base. The securement means may also take the form of an adhesive member 82 coupled to the planar surface and then couplable to the recipient surface. When the adhesive mode is utilized, a covering layer 84 is provided to temporarily shield the adhesive. The covering layer is then peeled off prior to attachment.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A cigarette handling system for extinguishing a lit cigarette and retaining the unlit cigarette for relighting in a safe, convenient and taste-retaining manner comprising, in combination:

a housing in a generally tubular configuration formed with a sidewall and an integrally formed circular bottom wall and an open upper end, the housing being fabricated of a rigid moldable plastic material, the housing having an exterior surface with a diameter of about 0.470 inches adjacent to the bottom wall and about 0.570 inches adjacent to the upper end, the housing having an interior surface with a diameter of about 0.350 inches adjacent to the bottom wall, the interior surface being hollow for forming a chamber adapted to receive a lit cigarette and with the sidewall tapering radially outwardly from adjacent to the bottom wall toward the upper end with the upper end being flared slightly to facilitate the guidance and entry of the lit end of a cigarette into the chamber, a lower end of the chamber having an undercut recess extending from the bottom wall to about 1.667 inches toward the upper end;

a cylindrical cup fabricated of a hard metal selected from a group consisting of aluminum, brass and steel, and positioned at the lower extent of the chamber, the cup having a lower circular plate positioned on the bottom wall of the housing and a cylindrical sidewall located within the recess, an open upper end adapted to receive a lit end of a cigarette, and an interior surface, the interior surface of the cup being in essential alignment with the interior surface of the housing adjacent to the lower end;

a cylindrical stopper having a diameter to fit over the upper end of the housing, the stopper having a cylindrical stopper of a reduced diameter extending inwardly into the housing to seal off and terminate the flow of oxygen into the housing;

a hinge integrally formed with the interior surface of the housing adjacent to the upper end and to the stopper; and a lock formed of a projection extending radially from the upper edge of the housing diametrically opposed from the hinge and a C-shaped clamp extending outwardly from the stopper adapted to removably couple with respect to the projection.

2. A cigarette handling system comprising:

a housing in a generally tubular configuration formed with a sidewall and an integrally formed circular bottom wall and an open upper end, the housing being fabricated of a rigid moldable plastic material, the housing having an exterior surface with a reduced diameter at the bottom wall and enlarged adjacent to the upper end, the housing having an interior surface, the interior surface being hollow for forming a chamber adapted to receive a lit cigarette and with the sidewall tapering radially outwardly from adjacent to the bottom wall toward the upper end with the upper end being flared slightly to facilitate guidance and entry of a lit end of a cigarette into the chamber;

an undercut recess extending from the bottom wall to about 1.667 inches toward the upper end; and a supplemental layer of heat resistant material on the interior surface of the housing formed as a cylindrical cup fabricated of a hard metal selected from the class of rigid metals including aluminum, brass and steel, and positioned at a lower extent of the chamber, the cup having a lower circular plate positioned on the bottom wall of the housing and a cylindrical sidewall located within the recess and an open upper end adapted to receive a lit end of a cigarette, an interior surface of the cup being in essential alignment with the interior surface of the housing adjacent to the bottom wall.

3. A cigarette handling system comprising:

a housing in a generally tubular configuration formed with a sidewall and an integrally formed circular bottom wall and an open upper end, the housing being fabricated of a rigid moldable plastic material plastics, the housing having an exterior surface with a reduced diameter at the bottom wall and enlarged adjacent to the top, the housing having an interior surface, the interior surface being hollow for forming a chamber adapted to receive a lit cigarette and with the sidewall tapering radially outwardly from adjacent to the bottom wall toward the upper end with the upper end being flared slightly to facilitate guidance and entry of a lit end of a cigarette into the chamber;

a supplemental layer of heat resistant material on the interior surface of the housing;

a slot formed in the sidewall from the upper end to a location adjacent to the longitudinal mid point of the a base to support the sidewall at an angle of about 45 degrees from the vertical.

4. A cigarette handling system comprising:

a housing in a generally tubular configuration formed with a sidewall and an integrally formed circular bottom wall and an open upper end, the housing being fabricated of a rigid moldable plastic material, the housing having an exterior surface with a reduced diameter at the bottom wall and enlarged adjacent to the top, the housing having an interior surface, the interior surface being hollow for forming a chamber adapted to receive a lit cigarette and with the sidewall tapering radially outwardly from adjacent to the bottom wall toward the upper end with the upper end being flared slightly to facilitate guidance and entry of a lit end of a cigarette into the chamber;

a supplemental layer of heat resistant material on the interior surface of the housing; and a generally U-shaped resilient component having a central extent in a generally oval shape pivotally secured to a central extent of the sidewall and also having spaced free ends adapted to pivotally couple to a collar secured to a central extent of the housing for optionally holding a lighter.

* * * * *